US010141693B2

(12) United States Patent
Zhao et al.

(10) Patent No.: US 10,141,693 B2
(45) Date of Patent: Nov. 27, 2018

(54) ELECTRICAL CONNECTOR WITH MIDDLE SHIELDING PLATE CONTACTING UPPER AND LOWER CONTACTS

(71) Applicant: FOXCONN INTERCONNECT TECHNOLOGY LIMITED, Grand Cayman (KY)

(72) Inventors: Jun Zhao, HuaiAn (CN); Tao Yao, Huaian (CN); Cai-Yun Zhang, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/461,501

(22) Filed: Mar. 17, 2017

(65) Prior Publication Data

US 2017/0271823 A1 Sep. 21, 2017

(30) Foreign Application Priority Data

Mar. 17, 2016 (CN) ..... 2016 1 0152120

(51) Int. Cl.
*H01R 24/00* (2011.01)
*H01R 13/6596* (2011.01)
(Continued)

(52) U.S. Cl.
CPC ..... *H01R 13/6596* (2013.01); *H01R 12/725* (2013.01); *H01R 12/727* (2013.01);
(Continued)

(58) Field of Classification Search
CPC ..... H01R 13/658; H01R 13/6585; H01R 13/6586; H01R 23/688; H01R 13/6587;
(Continued)

(56) References Cited

U.S. PATENT DOCUMENTS 9,490,595 B2 11/2016 Little et al.
2014/0187086 A1* 7/2014 Little ..... H01R 13/6585 439/607.34
2015/0325957 A1 11/2015 Liao et al.

FOREIGN PATENT DOCUMENTS

CN 203135087 U 8/2013
CN 203859327 U 10/2014
(Continued)

*Primary Examiner* — Abdullah Riyami
*Assistant Examiner* — Justin Kratt
(74) *Attorney, Agent, or Firm* — Wei Te Chung; Ming Chieh Chang

(57) ABSTRACT

An electrical connector for mounting on a printed circuit board includes an insulative housing having an upper contact module and a lower contact module. A row of upper contacts are retained in the upper contact module and a row of lower contacts are retained in the lower contact module. The row of upper contacts and the row of lower contacts includes plural conductive contacts and a pair of grounding contacts located at opposite sides of the conductive contacts. Each conductive contact is covered by matching surfaces of the upper contact module and the lower contact module, and each grounding contact is exposed on the matching surfaces of the upper contact module and the lower contact module. A shielding plate contacts the pair of grounding contacts in an up-to-down direction.

20 Claims, 13 Drawing Sheets

(51) Int. Cl.

| | |
|---|---|
| ***H01R 24/60*** | (2011.01) |
| ***H01R 12/72*** | (2011.01) |
| ***H01R 13/50*** | (2006.01) |
| ***H01R 13/405*** | (2006.01) |
| ***H01R 13/6585*** | (2011.01) |
| *H01R 107/00* | (2006.01) |
| *H01R 13/6581* | (2011.01) |
| *H01R 13/6586* | (2011.01) |
| *H01R 13/6587* | (2011.01) |
| *H01R 13/6594* | (2011.01) |
| *H01R 13/658* | (2011.01) |
| *H01R 13/6593* | (2011.01) |
| *H01R 12/50* | (2011.01) |

(52) U.S. Cl.
CPC ..... *H01R 13/405* (2013.01); *H01R 13/50* (2013.01); *H01R 13/6585* (2013.01); *H01R 24/60* (2013.01); *H01R 13/658* (2013.01); *H01R 13/6581* (2013.01); *H01R 13/6586* (2013.01); *H01R 13/6587* (2013.01); *H01R 13/6593* (2013.01); *H01R 13/6594* (2013.01); *H01R 23/688* (2013.01); *H01R 23/6873* (2013.01); *H01R 23/7073* (2013.01); *H01R 2107/00* (2013.01)

(58) Field of Classification Search
CPC ..... H01R 13/6594; H01R 23/6873; H01R 23/7073; H01R 13/6581; H01R 13/6593
USPC ..... 439/607.05, 607.4, 607.55, 676, 660
See application file for complete search history.

(56) References Cited

FOREIGN PATENT DOCUMENTS

| | | |
|---|---|---|
| CN | 203859328 U | 10/2014 |
| CN | 204885578 U | 12/2015 |
| TW | M464878 | 11/2013 |
| TW | M499669 | 4/2015 |

* cited by examiner

ELECTRICAL CONNECTOR WITH MIDDLE SHIELDING PLATE CONTACTING UPPER AND LOWER CONTACTS

BACKGROUND OF THE INVENTION

1. Field of the Invention

The present invention generally relates to an electrical connector having a metallic shielding plate that contacts upper and lower grounding contacts thereof.

2. Description of the Related Art

Universal Serial Bus (USB) and USB connectors are well known in the art. China Patent No. 203859328 discloses a reversible electrical connector including an insulative housing defining a base portion and a tongue portion extending forwardly from the base portion. The tongue portion defines opposite first and second surfaces and forms a slot. A plurality of first contacts are retained in the insulative housing and partially exposed on the first surface and a plurality of second contacts are retained in the insulative housing and partially exposed on the second surface. A metallic shielding plate includes a body portion and is located between the first contacts and the second contacts. A pair of grounding arms extend from opposite sides of the body portion, passing through the slot, to contact first and second grounding contact.

BRIEF SUMMARY OF THE INVENTION

Therefore, an object of the present invention is to provide an electrical connector having a shielding plate securely contacts upper and lower grounding contacts thereof.

To fulfill the above-mentioned object, an electrical connector comprises: an insulative housing comprising an upper contact module and a lower contact module; a row of upper contacts retained in the upper contact module and a row of lower contacts retained in the lower contact module, the row of upper contacts including a plurality of first conductive contacts and at least one first grounding contact located at one side of the plurality of first conductive contacts, the row of lower contacts including a plurality of second conductive contacts and at least one second grounding contact located at one side of the plurality of second conductive contacts; a metallic shielding plate located between the upper contact module and the lower contact module; wherein each first conductive contact defines a first bottom surface covered by the upper contact module and the at least one first grounding contact defines a second bottom surface exposed on a lower surface of the upper contact module; each second conductive contact defines a first upper surface covered by the lower contact module and the at least one second grounding contact defines a second upper surface exposed on an upper surface of the lower contact module; and the metallic shielding plate contacts the second bottom surface of the at least one first grounding contact and the second upper surface of the at least one second grounding contact.

Other objects, advantages and novel features of the invention will become more apparent from the following detailed description when taken in conjunction with the accompanying drawings.

BRIEF DESCRIPTION OF THE DRAWINGS

The foregoing summary, as well as the following detailed description of the embodiments of the present invention, will be better understood when read in conjunction with the appended drawings. For the purpose of illustrating the invention, there are shown in the drawings embodiments which are presently preferred. As should be understood, however, the invention is not limited to the precise arrangements and instrumentalities shown. In the drawings.

DETAILED DESCRIPTION OF THE PREFERRED EMBODIMENT

Reference will now be made in detail to the preferred embodiment of the present invention.

Figure 1:
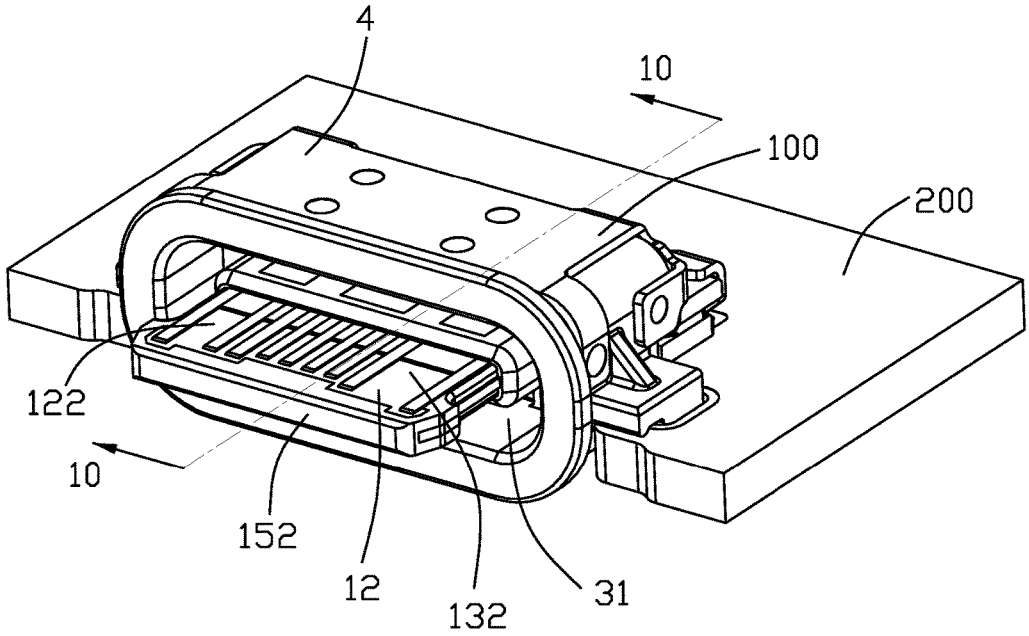
FIG. 1 is a perspective view of an electrical connector assembly in accordance with the present invention mounted to a printed circuit board.
Figure 2:
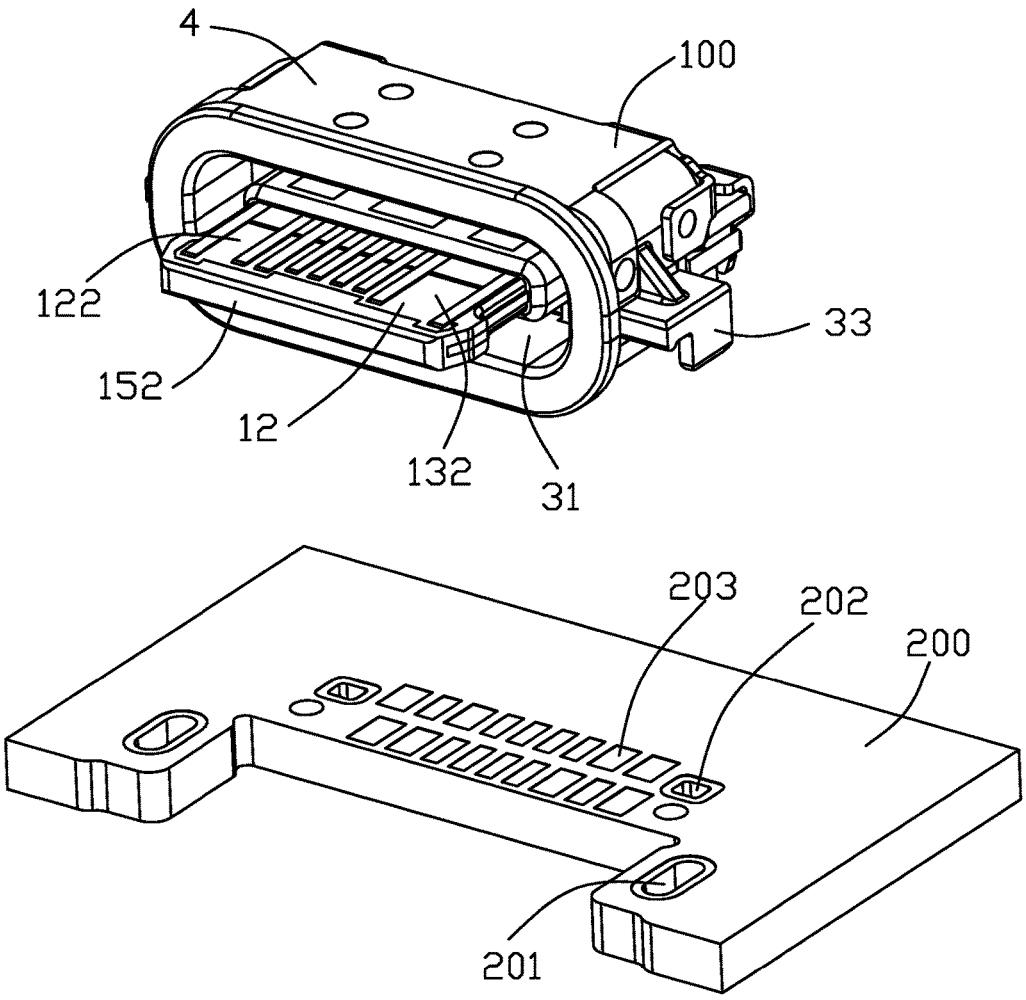
FIG. 2 is an exploded view of the electrical connector and the printed circuit board of the electrical connector.
Figure 3:
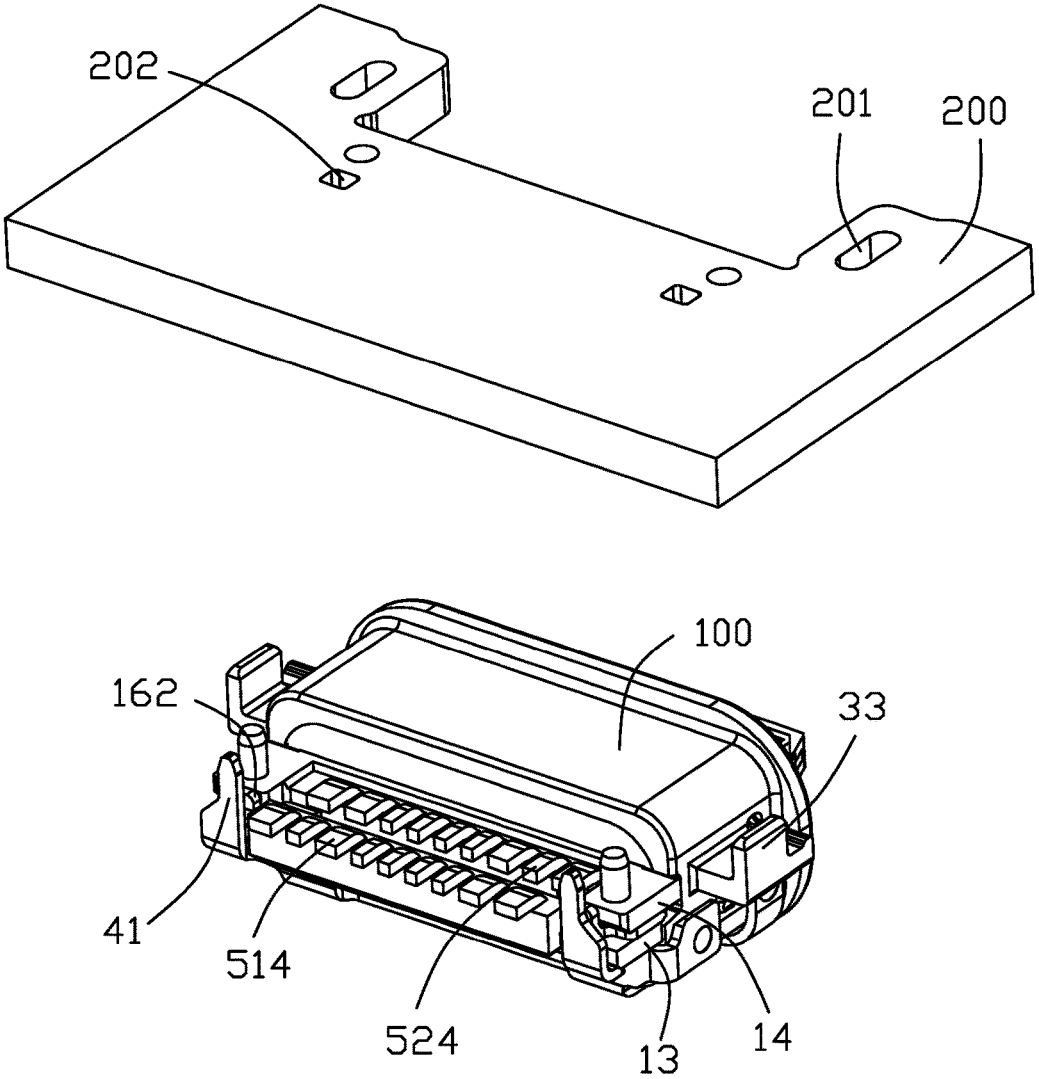
FIG. 3 is another perspective, exploded view of FIG. 1.
Figure 4:
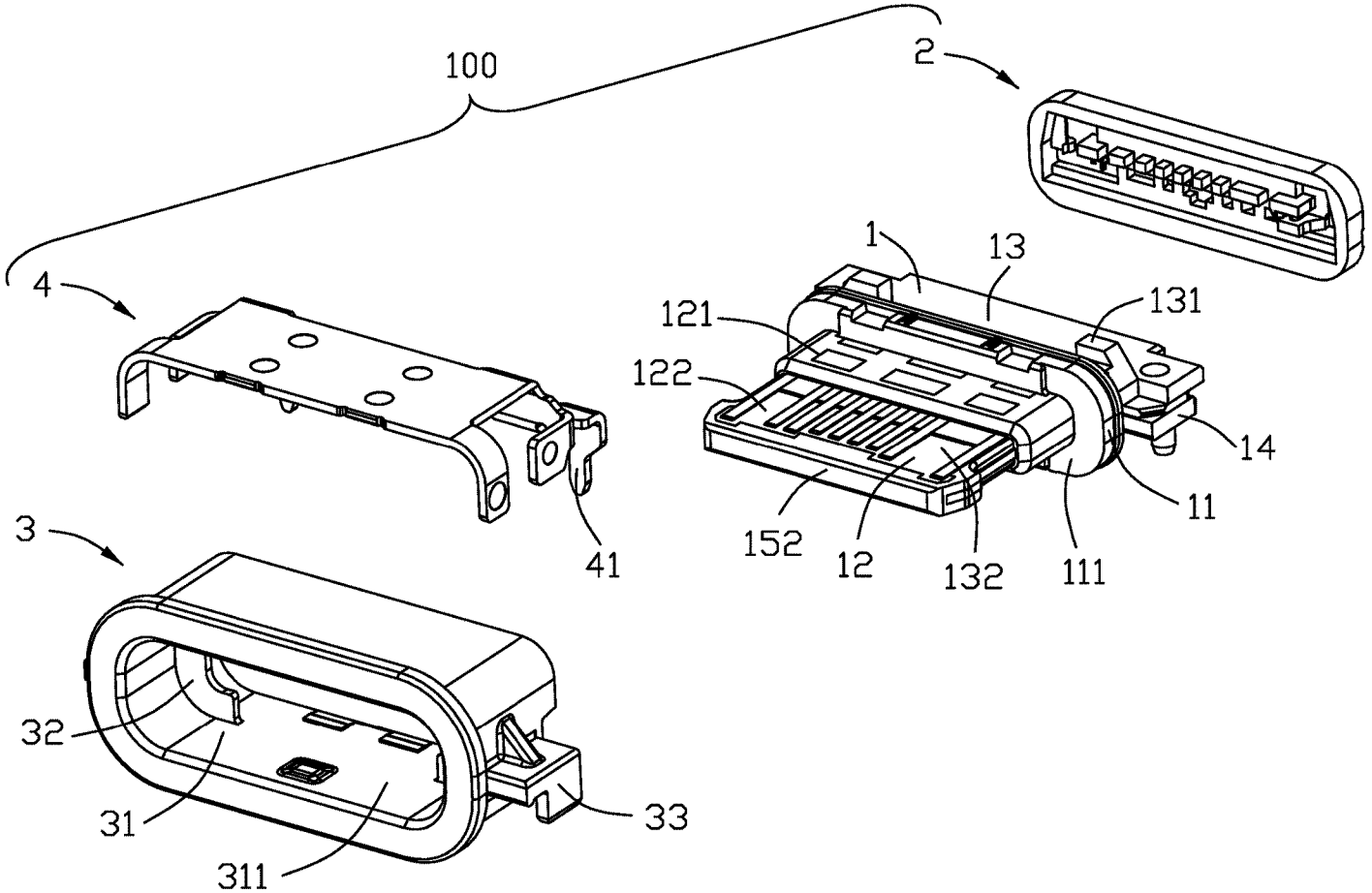
FIG. 4 is a partly exploded perspective view showing the electrical connector.
Figure 5:
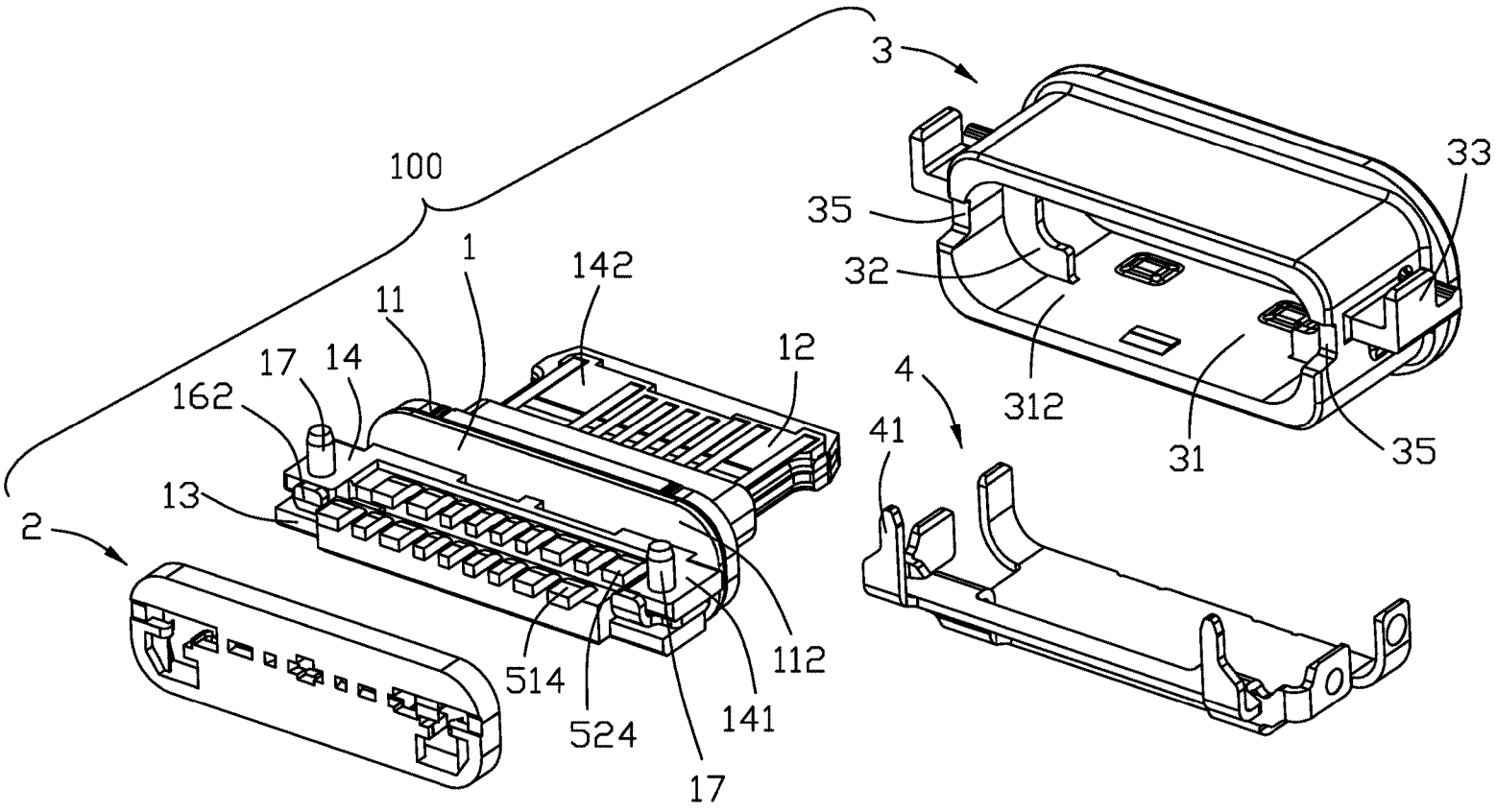
FIG. 5 is another view similar to FIG. 4, taken from another aspect.
Figure 6:
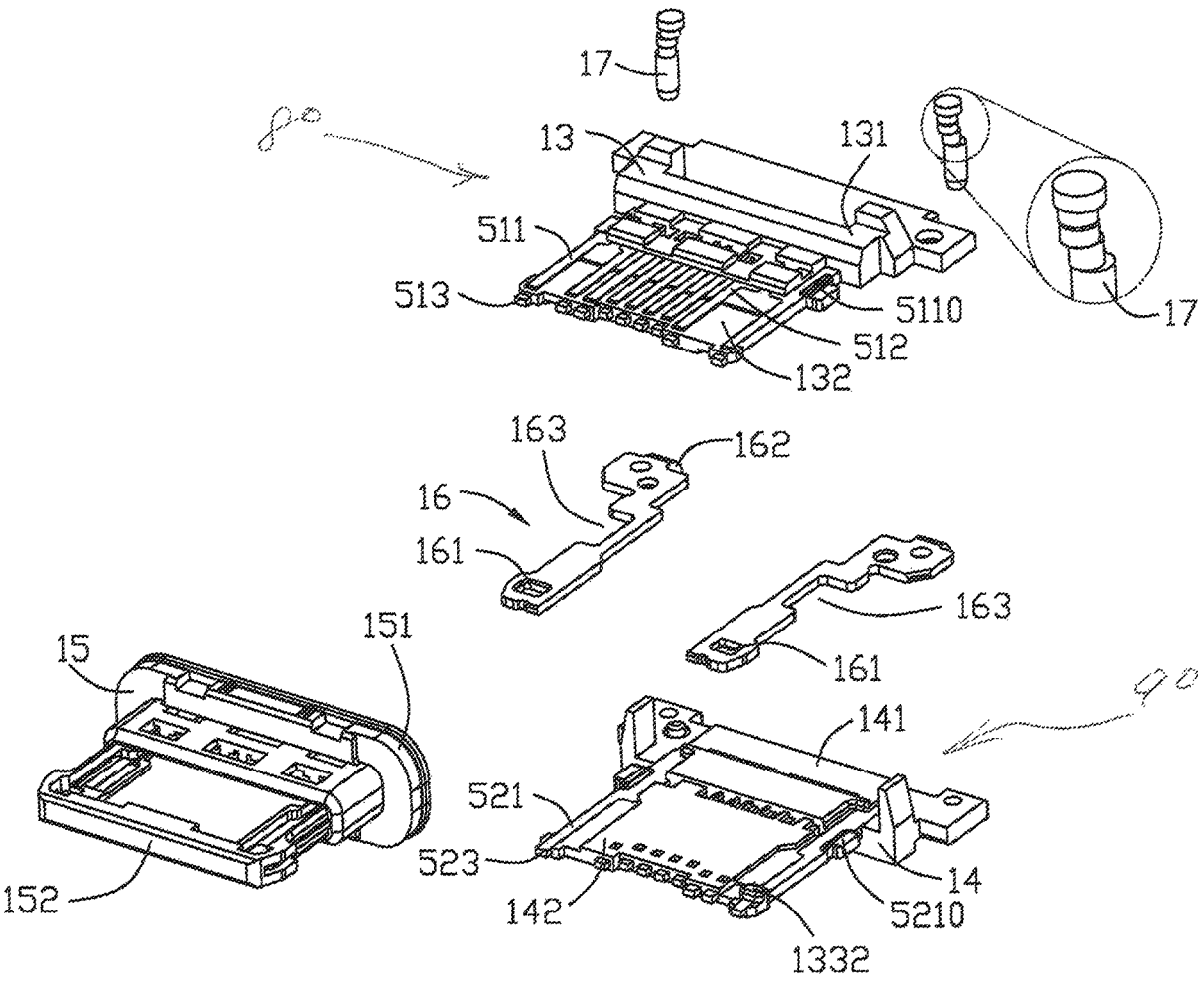
FIG. 6 is a perspective, exploded view of the electrical connector without an inner metallic shell, an outer shell and a glue plate.
Figure 7:
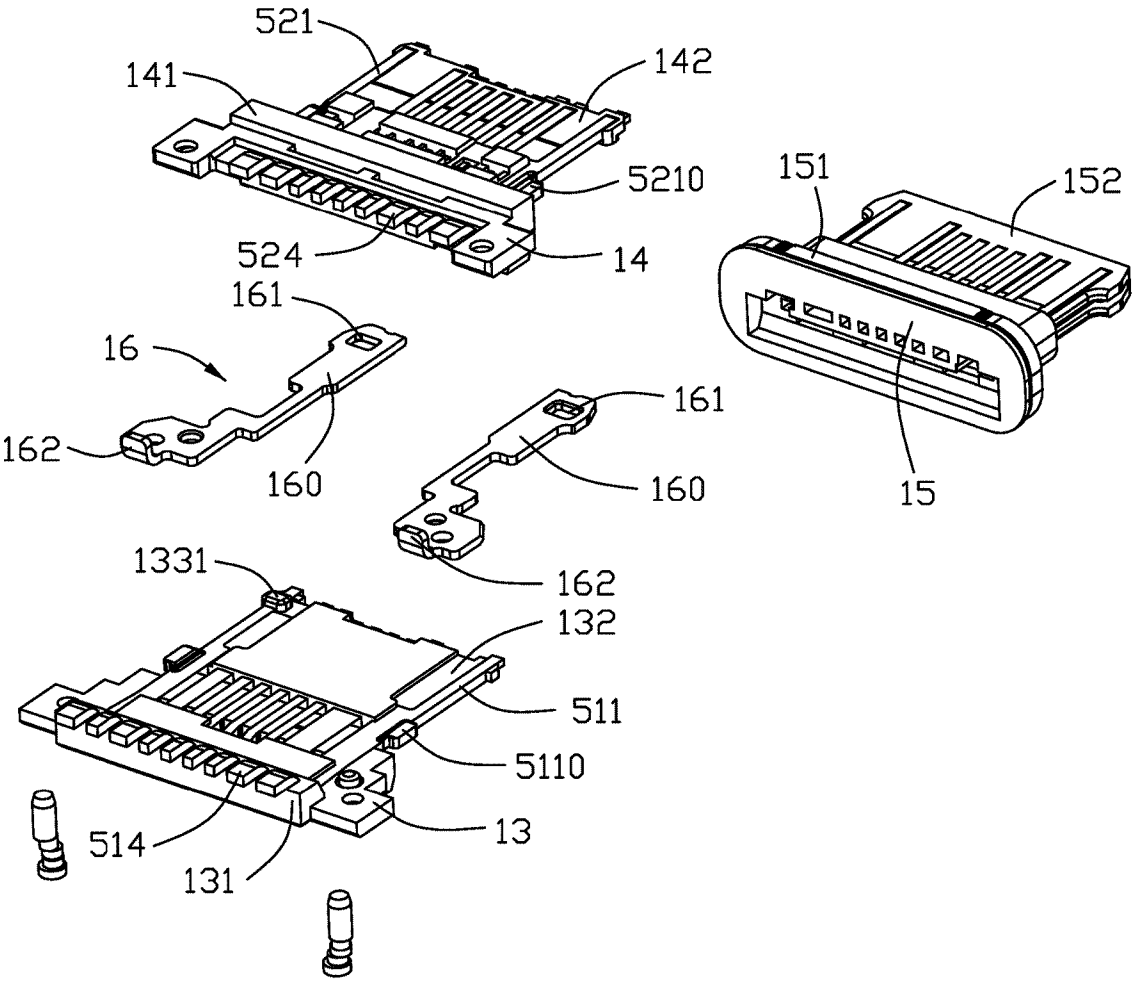
FIG. 7 is another view similar to FIG. 6, taken from another aspect.
Figure 8:
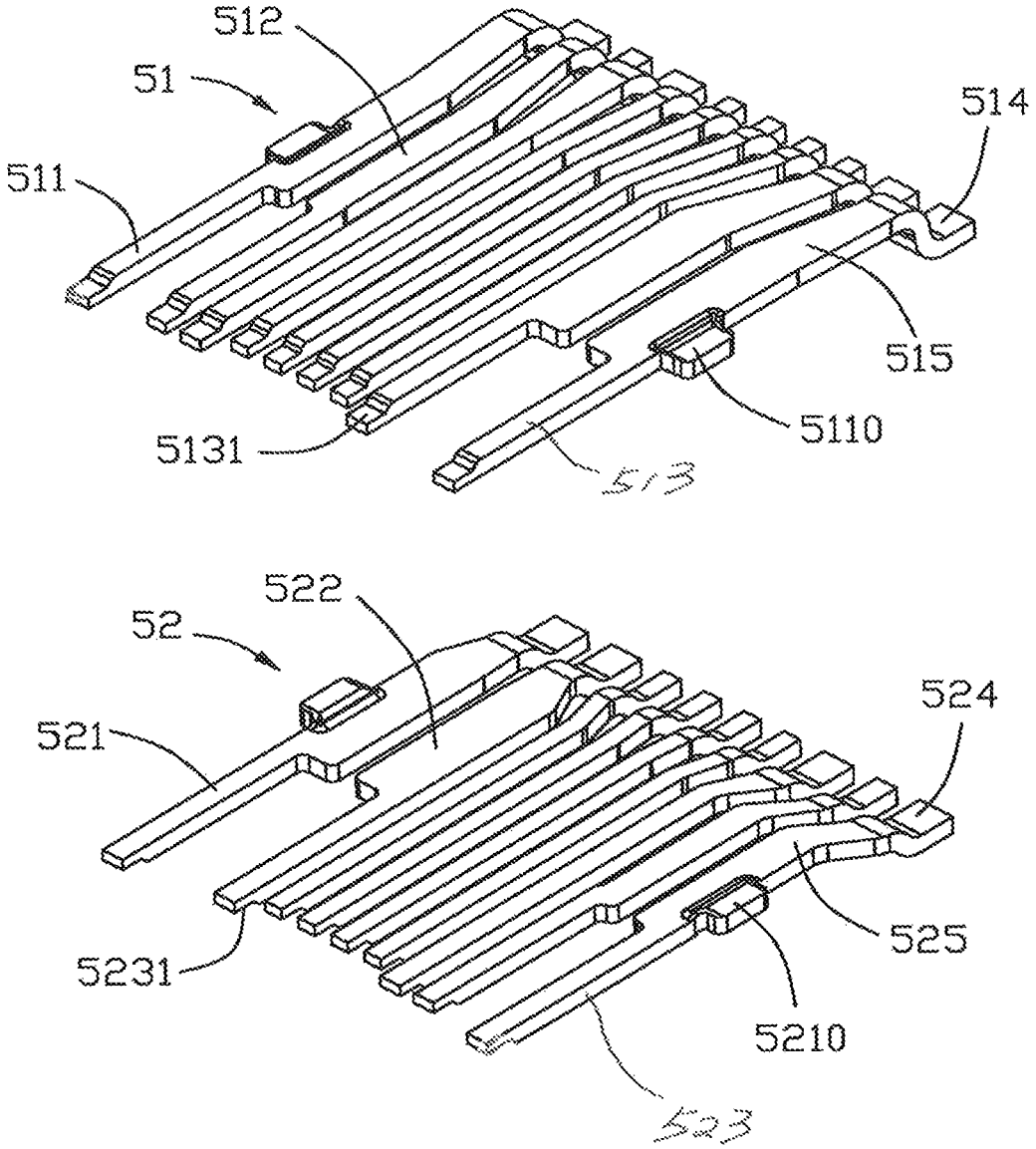
FIG. 8 is a perspective view of a row of upper contacts and a row of lower contacts.
Figure 9:
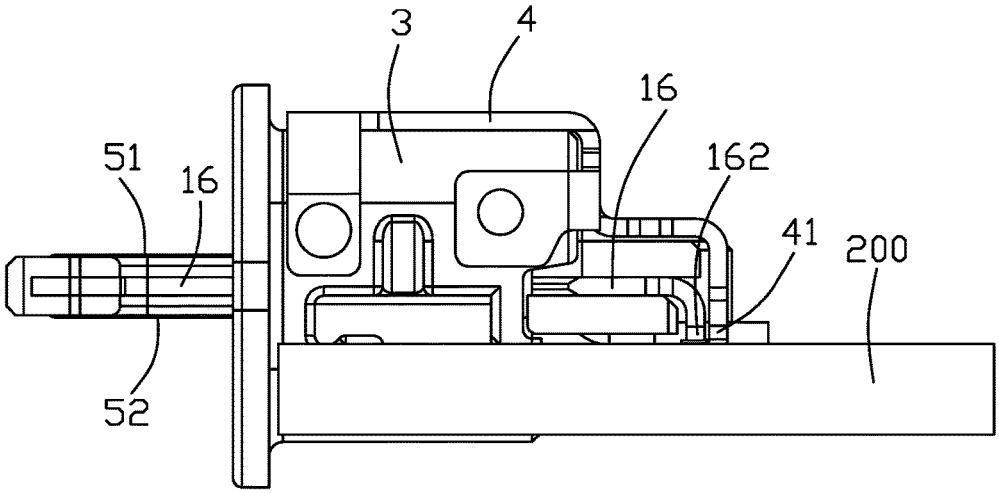
FIG. 9 is a side view of the electrical connector assembly of FIG. 1.
Figure 9A:
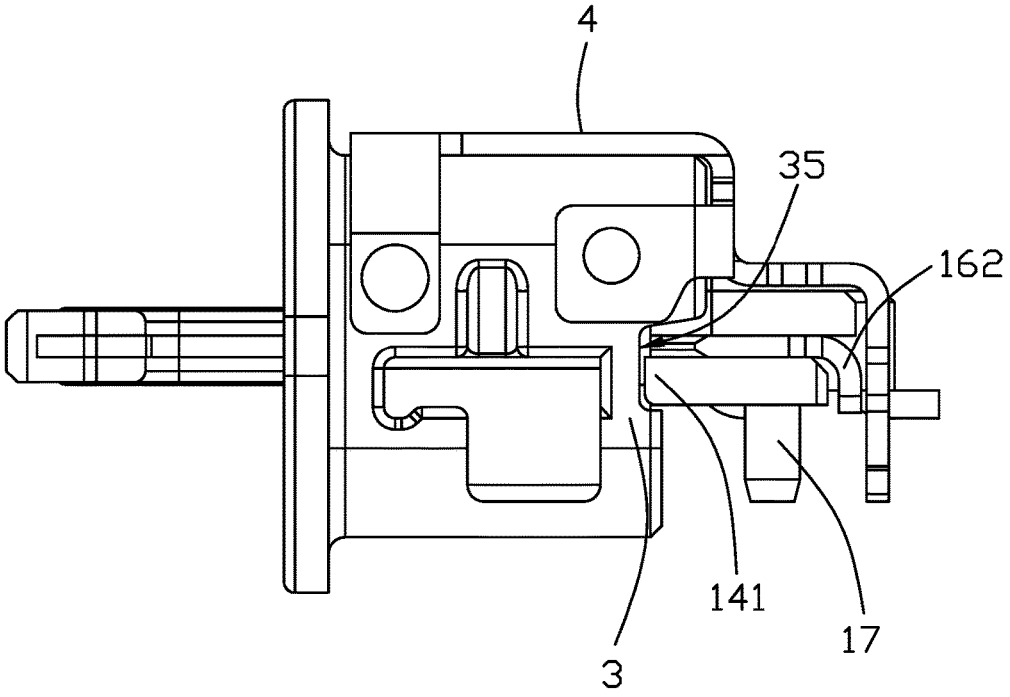
FIG. 9(A) is a side view of the electrical connector assembly of FIG. 1 without the printed circuit board.
Figure 10A:
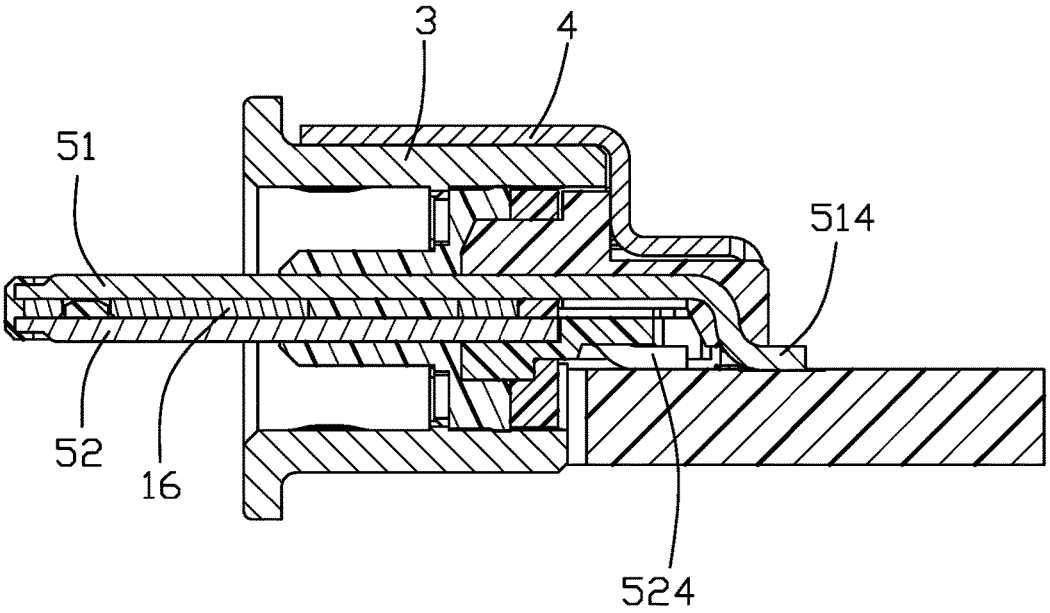
FIG. 10(A) is a cross-sectional view of the electrical connector assembly along line 10(A)-10(A) in FIG. 1.
Figure 10B:
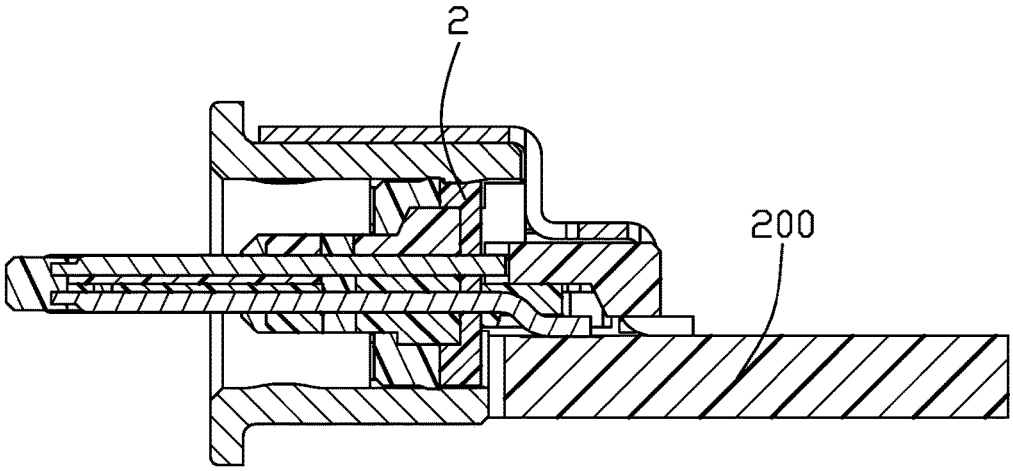
FIG. 10(B) is a cross-sectional view of the electrical connector assembly along line 10(B)-10(B) in FIG. 1.
Figure 10C:
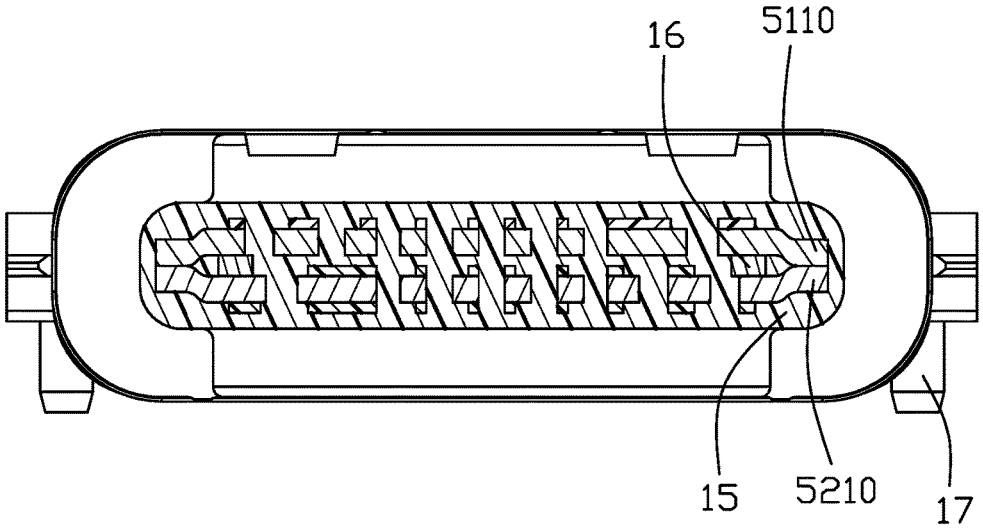
FIG. 10(C) is a cross-sectional view of the electrical connector assembly along line 10(C)-10(C) in FIG. 1.

Please referring to FIGS. 1-10(C), an electrical connector 100 is intended to be mounted on a printed circuit board 200. The electrical connector 100 comprises an insulative housing 1, a glue plate 2, a seamlessly inner metallic shell 3, an outer shell 4, a plurality of contacts retained in the insulative housing 1, and a metallic shielding plate 16.

Please referring to FIGS. 4-10, the insulative housing defines a base portion 11 and a tongue portion 12 extending forwardly from the base portion 11. The base portion 11 defines a front face 111 and a rear face 112 opposite to the front face 111, the tongue portion defines a first body 121 and a second body 122 extending forwardly from the front face 111 in turn. The insulative housing 1 is made of insulating material and defines an upper contact module 13, a lower contact module 14, and an insulator 15. The upper contact module 13 includes a first base portion 131 and a first tongue 132 extending forwardly from the first base portion 131, the lower contact module 14 includes a second base portion 141 and a second tongue portion 142 extending forwardly from the second base portion 141, The insulator 15 includes a third base portion 151 and a third tongue portion 152 extending forwardly from the third base portion 151. The first base portion 131, the second base portion 141, and the third base portion 151 are jointly form the base portion 11. The first tongue portion 132, the second tongue portion 142, and the third tongue portion 152 are jointly form the tongue portion 12.

The plurality of contacts include a row of upper contacts 51 retained in the upper contact module 13 and a row of lower contacts 52 retained in the lower contact module 14, the row of upper contacts 51 and the row of lower contacts 52 have the same number, the thickness of each contact is 0.25 millimeter for transmitting high current. The row of upper contacts 51 and the row of lower contacts 52 are positioned to have 180 degree symmetry such that the corresponding plug connector (not figured) can be inserted and operatively coupled to the electrical connector 100 in either of two orientations.

The row of upper contacts 51 include a plurality of first conductive contacts 512 and a pair of first grounding contacts 511 located at opposite sides of the plurality of first conductive contacts 512. Each upper contact 51 defines a first contacting section or portion 513, a first connecting portion 515 extending backwardly from the first contacting portion 513, and a first soldering portion 514 extending backwardly from the first connecting portion 515. The first contacting portion 513 defines a front thin portion 5131, the first connecting portion 515 of the first grounding contact 512 defines a first abutting portion 5110 projecting downwardly from an outer side edge thereof. The upper contact module 13 defines a first projecting portion 1331 located at a front region corresponding the first grounding contact 511 for retaining the first grounding contact 511.

The row of lower contacts 52 include a plurality of second conductive contacts 522 and a pair of second grounding contacts 521 located at opposite sides of the plurality of first conductive contacts 522. Each lower contact 52 defines a second contacting section or portion 523, a second connecting portion 525 extending backwardly from the second contacting portion 523, and a second soldering portion 524 extending backwardly from the second connecting portion 525. The second contacting portion 523 defines a front thin portion 5231, the second connecting portion 525 of the second grounding contact 522 defines a second abutting portion 5210 projecting upwardly from an outer side edge thereof. The lower contact module 14 defines a second projecting portion 1332 located at a front region corresponding the second grounding contact 521 for retaining the second grounding contact 521.

The inner metallic shell 3 is a one-piece shell and having an inserting space 31 with a stopping portion 32 therein, a pair of retaining feet 33 formed on opposite outer sides of the inner metallic shell 3. The stopping portion 32 divides the inserting space 31 into a front space 311 and a rear space 312. The outer shell 4 defines a pair of first soldering feet 41 mounting on the printed circuit board 200. The metallic shielding plate 16 defines a 0.2 millimeter thickness and including a pair of shielding plates 160 separated from each other, each shielding plate 160 defines a hole 161 for receiving the first projecting portion 1331 and the second projecting portion 1332 respectively, and a second soldering foot 162 corresponding each first soldering foot 41 for mounting on the printed circuit board 200. The printed circuit board 200 defines a pair of soldering grooves 201 for soldering the pair of retaining feet 33, a pair of soldering holes 202 for soldering the pair of first soldering feet 41 and two second soldering feet 162, and a plurality of soldering pads 203 for soldering the first soldering contacts 514 and the second soldering contacts 524. Each shielding plate 160 defines a groove 163 for giving way to the first abutting portion 5110 and the second abutting portion 5210 in an up-to-down direction.

The steps of making the electrical connector 100 are as follows. Step 1: the row of upper contacts 51 are integrally assembled with the upper contact module 13 to form a contact unit 80 (FIG. 6) and the row of lower contacts 52 are integrally assembled with the lower contact module 14 to form a contact unit 90 (FIG. 6), via a first stage insert-molding process. Then, a first bottom surface of the first conductive contacts 512 and a first upper surface of the second conductive contacts 522 are covered with the upper contact module 13 and the lower contact module 14 respectively, and a second bottom surface of the first grounding contacts 511 and a second upper surface of the second grounding contacts 521 are exposed on a lower surface of the upper contact module 13 and an upper surface of the lower contact module 14 respectively.

Step 2: the metallic shielding plate 16 is clamp between the upper contact module 13 and the lower contact module 14. Then, each shielding plate 160 directly contacts the second bottom surface and the second upper surface of each first grounding contact 521 and corresponding second grounding contact 522 in the up-to-down direction, and the first conductive contacts 512 and the second conductive contacts 522 are separated from each other by insulating material. The first projecting portion 1331 and the second projecting portion 1332 pass through the hole 161 of each shielding plate 160 for retaining the shielding plate 160. The first abutting portion 5110 solders with the second abutting portion 5210 for combining the upper contact module 13 together with the lower contact module 14 stably.

Step 3: the combining upper contact module 13 and lower contact module 14 are integrally assembled with the insulator 15, via a second stage insert-molding process. The front thin portion 5131 of the first contacting portion 513 and the front thin portion 5231 of the second contacting portion 523 are embedded in the insulator 1.

Step 4: the insulative housing 1 is inserted into the inner metallic shell 3. Then, the base portion 11 rests on the stopping portion 32 from a rear-to-front direction with the tongue portion 12 protruding into the front space 311. The first body 121 of the tongue portion 12 is received in the front space 311 and the second body 122 extends beyond the front space 311. Glue is then injected into a rear face of the base portion for forming the glue plate 2 to seal the rear space 312.

Step 5: the outer shell 4 cover on a top surface of the inner metallic shell 3 by spot welding process, with each first soldering foot 41 of the outer shell 4 and the second soldering foot 162 abut against each other.

Step 6: the electrical connector 100 is mounted on the printed circuit board 200. Then, the pair of retaining feet 33 are soldered in the pair of soldering grooves 201, the plurality of first soldering portions 514 and second soldering portions 524 are soldered on the plurality of soldering pads 203, each second soldering foot 162 is soldered on top surface of the soldering hole 202, and each first soldering foot 41 passes through the soldering hole 202 and is soldered in the soldering hole 202.

The invention includes several features. The contact 51, 52 has a thickness of 0.25 mm and the shielding plate 16 has a thickness of 0.2 mm so that the first grounding contact 511 and the second grounding contact 521 not only commonly directly and intimately sandwich the shielding plate 16 therebetween in the vertical direction but also directly intimately mechanically connect to each other via the corresponding first abutting portion 5110 and second abutting portion 5210 in the vertical direction. In addition, the first abutting portion 5110 and the second abutting portion 5210 are welded together so as to fasten together the first contact module 13, which is associated with the first contacts 51 as a first contact unit, and the second contact module 14, which is associated with the second contacts 52 as a second contact unit, with the shielding plates 16 therebetween in the vertical direction so as to further be applied with the insulator 15 to form a complete terminal module. The metallic inner shell forms a pair of notches 35 to receive a front edge region of the second base portion 141 so as to stabilize the whole terminal module in the inner shell 3 wherein the stopping portion 32 prevents further movement of the whole terminal module, and the first soldering foot 41 of the outer shell 4 abuts against the second soldering foot 162 of the shielding plate 16 to prevent the backward movement of the whole terminal module. Notably, because each of the first grounding contact 511 and the second grounding contact 521 requires to expose its inner side to contact the corresponding shielding plate 16, it lacks the support from the corresponding first/second contact module 13/14 in the vertical direction. Therefore, the first/second contact module 13/14 forms the corresponding first/second projecting portion 1331/1332 to retain the corresponding first/second grounding contact 511/512 wherein the first/second projecting portion 1331/1332 is further received within the corresponding opening of the corresponding shielding plate 16. It is also noted that on one hand, the insulator 15 is, at the second stage insert-molding process, insert-molded upon the contact module 13, the second contact module 14 and the shielding plates 16 therebetween, to secure those three parts together. On the other hand, the pair of mounting posts 17 are also, at the second insert-molding stage, insert-molded to those three parts to extend through the corresponding three through holes in those three parts wherein the center axes of those three through holes are not aligned in the vertical direction, so such the mounting post 17 may provide the securing effect to retain those three parts together, in addition to the original mounting effect.

It is to be understood, however, that even though numerous, characteristics and advantages of the present invention have been set fourth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing comprising an upper contact module and a lower contact module;

a row of upper contacts retained in the upper contact module and a row of lower contacts retained in the lower contact module, the row of upper contacts including a plurality of first conductive contacts and at least one first grounding contact located at one side of the plurality of first conductive contacts, the row of lower contacts including a plurality of second conductive contacts and at least one second grounding contact located at one side of the plurality of second conductive contacts;

a metallic shielding plate located between the upper contact module and the lower contact module; wherein each first conductive contact defines a first bottom surface covered by the upper contact module and the at least one first grounding contact defines a second bottom surface exposed on a lower surface of the upper contact module, each second conductive contact defines a first upper surface covered by the lower contact module and the at least one second grounding contact defines a second upper surface exposed on an upper surface of the lower contact module, the metallic shielding plate contacts the second bottom surface of the at least one first grounding contact and the second upper surface of the at least one second grounding contact, and there are two first grounding contacts located at opposite sides of the plurality of first conductive contacts, there are two second grounding contacts located at opposite sides of the plurality of second conductive contacts, and there are two metallic shielding plates located between corresponding first and second grounding contacts.

2. The electrical connector as claimed in claim 1, wherein each first grounding contact defines a first abutting portion projecting downwardly from an outer side edge thereof, and each second grounding contact defines a second abutting portion projecting upwardly from an outer lateral edge thereof to mechanically contact corresponding first abutting portion.

3. The electrical connector as claimed in claim 2, wherein each shielding plate defines a groove for giving way to the first abutting portion and the second abutting portion in an up-to-down direction.

4. The electrical connector as claimed in claim 1, wherein the upper contact module defines a first projecting portion at a front region thereof for retaining the first grounding contact and the lower contact module defines a second projecting portion located at a front region thereof for retaining the second grounding contact, and each shielding plate defines a respective hole cooperating with the first projecting portion and the second projecting portion.

5. The electrical connector as claimed in claim 1, wherein the insulative housing comprises an insulator, and the upper contact module and the lower contact module are integrally assembled with the insulator.

6. The electrical connector as claimed in claim 1, further comprising a seamless inner metallic shell, the inner metallic shell including an inserting space with a stopping portion therein, the stopping portion dividing the inserting space into a front space and a rear space, and wherein the insulative housing is received in the inner metallic shell and defines a base portion and a tongue portion extending forwardly from the base portion, the base portion defining a front surface resting on the stopping portion, the tongue portion protruding into the front space.

7. The electrical connector as claimed in claim 6, further comprising a glue plate, and wherein the base portion is received in the rear space and defines a rear surface, the glue plate covering the rear surface of the base portion to seal the rear space.

8. The electrical connector as claimed in claim 6, further comprising an outer shell having a pair of first soldering feet at a rear end thereof, and wherein each of the two metallic shielding plates has a second soldering foot adjacent to a corresponding one of the pair of first soldering feet.

9. An electrical connector comprising:

a metallic shell; and a terminal module received in the metallic shell, said terminal module including:

an insulative housing defining a rear base and front tongue portion extending forwardly from the base along a front-to-back direction, said tongue portion forming thereon opposite first and second surfaces in a vertical direction perpendicular to said front-to-back direction;

a plurality of first contacts disposed in the housing with first contacting sections exposed upon the first surface and spaced from one another in a transverse direction perpendicular to both said front-to-back direction and said vertical direction;

a plurality of second contacts disposed in the housing with second contacting sections exposed upon the second surface and spaced from one another in the transverse direction; and at least one shielding plate located around a lateral side of the tongue portion and between at least one of the first contacting sections and at least one of the second contact sections; wherein said shielding plate is directly and intimately mechanically connected to said at least one of the first contacting sections and said at least one of the second contacting sections in the vertical direction, and said at least one first contacting section further includes a first abutting portion, and said at least one second contacting section further includes a second abutting portion soldered with the first abutting portion for securing and grounding.

10. The electrical connector as claimed in claim 9, wherein a thickness of the first contacting section and that of the second contacting section are the same with each other around 0.25 mm, which is thicker than that of the shielding plate.

11. The electrical connector as claimed in claim 10, wherein said housing includes a first contact module integrally formed with said first contacts via a first stage insert-molding process to commonly form a first contact unit, and a second contact module integrally formed with said second contacts via another first stage insert-molding process to commonly form a second contact unit, said first contact unit and said second contact unit being secured together with the shielding plate therebetween in the vertical direction via soldering between the first abutting portion and the second abutting portion.

12. The electrical connector as claimed in claim 11, wherein an insulator is further applied upon the assembled first contact unit and second contact unit to form said terminal module, and said first abutting portion and said second abutting portion are embedded within the insulator.

13. The electrical connector as claimed in claim 11, wherein the first contact module, the second contact module and the shielding plate form respective through holes, and a mounting post extends through said through holes with a center axis with offset sections thereof for not only mounting the connector upon a printed circuit board but also securing the first contact module, the shielding plate and the second contact module together in the vertical direction.

14. The electrical connector as claimed in claim 9, wherein said metallic shell includes a metallic inner shell made from die-casting and a metallic outer shell made from stamping and forming and soldered upon the inner shell, the inner shell forms a stopping portion to rearwardly abut against the terminal module for preventing a forward movement of the terminal module, and the outer shell having has a portion to forwardly abut against the terminal module for preventing a backward movement of the terminal module.

15. The electrical connector as claimed in claim 14, wherein the shielding plate has a portion mechanically and electrically connected to the outer shell.

16. An electrical connector comprising:

a metallic shell; and a terminal module received in the metallic shell, said terminal module including:

an insulative housing defining a rear base and front tongue portion extending forwardly from the base along a front-to-back direction, said tongue portion forming thereon opposite first and second surfaces in a vertical direction perpendicular to said front-to-back direction;

a plurality of first contacts disposed in the housing with first contacting sections exposed upon the first surface and spaced from one another in a transverse direction perpendicular to both said front-to-back direction and said vertical direction;

a plurality of second contacts disposed in the housing with second contacting sections exposed upon the second surface and spaced from one another in the transverse direction; and at least one shielding plate located around a lateral side of the tongue portion and between at least one of the first contacting sections and at least one of the second contact sections; wherein said metallic shell includes a metallic inner shell made from die-casting and a metallic outer shell made from stamping and forming and soldered upon the inner shell, the inner shell forms a stopping portion to rearwardly abut against the terminal module for preventing forward movement of the terminal module, and the outer shell has a portion to forwardly abut against the terminal module for preventing backward movement of the terminal module.

17. The electrical connector as claimed in claim 16, wherein the shielding plate has a rear portion mechanically and electrically connected to the outer shell.

18. The electrical connector as claimed in claim 17, wherein said outer shell includes a soldering foot which the rear portion of said shielding plate abuts against.

19. An electrical connector comprising:

a metallic shell; and a terminal module received in the metallic shell, said terminal module including:

an insulative housing defining a rear base and front tongue portion extending forwardly from the base along a front-to-back direction, said tongue portion forming thereon opposite first and second surfaces in a vertical direction perpendicular to said front-to-back direction;

a plurality of first contacts disposed in the housing with first contacting sections exposed upon the first surface and spaced from one another in a transverse direction perpendicular to both said front-to-back direction and said vertical direction;

a plurality of second contacts disposed in the housing with second contacting sections exposed upon the second surface and spaced from one another in the transverse direction; and at least one shielding plate located around a lateral side of the tongue portion and between at least one of the first contacting sections and at least one of the second contact sections; wherein said shielding plate is directly and intimately mechanically connected to said at least one of the first contacting sections and said at least one of the second contacting sections in the vertical direction, and said metallic shell includes a metallic inner shell made from die-casting and a metallic outer shell made from stamping and forming and affixed upon the inner shell, the inner shell forms a stopping portion to rearwardly abut against the terminal module for preventing forward movement of the terminal module, and the outer shell has a portion to forwardly abut against the terminal module for preventing a backward movement of the terminal module.

20. The electrical connector as claimed in claim 19, wherein the shielding plate has a portion mechanically and electrically connected to the outer shell.

* * * * *